United States Patent [19]

Nijman

[11] 4,036,547

[45] July 19, 1977

[54] ELECTRICAL CONNECTOR HAVING AN ELONGATE REAR SLOT COMMUNICATING WITH CONDUCTOR RECEIVING CHANNELS VIA CONDUCTOR RECEIVING AND HOLDING NOTCHES

[75] Inventor: John Peter Nijman, West Hill, Canada

[73] Assignee: Bunker Ramo Corporation, Oak Brook, Ill.

[21] Appl. No.: 708,930

[22] Filed: July 27, 1976

Related U.S. Application Data

[60] Continuation of Ser. No. 527,998, Nov. 29, 1974, abandoned, which is a division of Ser. No. 402,132, Oct. 1, 1973, Pat. No. 3,866,293.

[51] Int. Cl.[2] ..... H01R 11/20

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,611,264 | 10/1971 | Ellis | 339/99 R |
| 3,760,335 | 9/1973 | Roberts | 339/99 R |
| 3,866,996 | 2/1975 | Elkins | 339/99 R |
| 3,877,771 | 4/1975 | Jensen | 339/99 R |

*Primary Examiner*—Roy Lake
*Assistant Examiner*—Mark S. Bicks
*Attorney, Agent, or Firm*—William Lohff; F. M. Arbuckle

[57] ABSTRACT

Techniques for terminating a plurality of free-ended insulated electrical conductors in respective insulation-piercing contacts carried in respective parallel channels of an electrical connector include supporting the connector on a base with the channels exposed to receive the respective conductors, and moving an insertion tool generally parallel to the connector to sequentially insert the conductors within the respective channels and insulation-piercing contacts. The connector may advantageously comprise a notched ridge, with each notch in communication with a respective channel for preparatory alignment before insertion. The entire terminating apparatus resembles a credit card impression mechanism with a wheeled carriage supported to traverse a base in opposite directions. In one embodiment, a wire cutter, supported by the carriage, advances in front of the insertion tool to cut the ends of the wires before insertion. In this embodiment, the insertion tool performs the insertion operation upon return of the carriage. In a second embodiment, the insertion tool includes the wire cutter and operates to cut the wires contemporaneously with insertion thereof.

In another embodiment, a wire cutter is carried between a wire pulling and seating member and the insertion tool, whereby the individual wires are snugged in each channel, and then cut to a predetermined length before insertion. In each embodiment, the insertion tool resembles a gear having insertion members as gear teeth. In the first two mentioned embodiments, the gear is a cylindrical rotatable member, while in the third embodiment, a sector gear is pivotally mounted for rotation of less than a complete revolution.

3 Claims, 9 Drawing Figures

ELECTRICAL CONNECTOR HAVING AN ELONGATE REAR SLOT COMMUNICATING WITH CONDUCTOR RECEIVING CHANNELS VIA CONDUCTOR RECEIVING AND HOLDING NOTCHES

This is a continuation of application Ser. No. 527,998, filed Nov. 29, 1974, now abandoned, which was a division of Ser. No. 402,132, filed Oct. 1, 1973, which issued Feb. 18, 1975 as U.S. Pat. No. 3,866,293.

BACKGROUND OF THE INVENTION

1. Field of the Invention

This invention relates to a method and apparatus for terminating insulated conductors in respective insulation-piercing contacts of an electrical connector, and electrical connector construction which advantageously facilitates conductor insertion. More specifically, the invention relates to techniques for sequentially inserting insulated conductors in respective insulation-piercing contacts of an electrical connector.

2. Description of the Prior Art

Termination of the free ends of a plurality of conductors in respective insulation-piercing contacts of an electrical connector is generally known in the art and ranges from machine insertion of a plurality of conductors simultaneously in respective insulation-piercing contacts to individual manual insertion of conductors. Each of these techniques has its advantages and disadvantages. For example, a machine may be utilized to advantage to quickly insert a large number of conductors. However, such machines are rather complex and expensive. On the other hand, manual insertion is relatively inexpensive in situations where a few conductors are to be terminated, yet becomes an extremely slow and expensive process when it is necessary to terminate a large number of conductors, particularly as a continuously repetitive operation.

SUMMARY OF THE INVENTION

It is therefore the primary object of the invention to provide a method and apparatus for terminating a plurality of electrical conductors in respective insulation-piercing contacts of an electrical connector by utilizing the advantages of both machine and hand insertion techniques, while at the same time overcoming the disadvantages normally attendant to machine and manual operations.

Another object of the invention is to provide a new and improved manually operated conductor terminating machine.

Another object of the invention is to provide an improved electrical connector construction which facilitates the positioning of conductors for machine insertion.

Another object of the invention is to provide a new and improved manually operated conductor insertion machine which sequentially terminates a plurality of conductors in respective insulation-piercing contacts disposed in respective parallel aligned channels of an electrical connector.

Still another object of the invention is to provide cutting apparatus operable to sequentially cut a plurality of conductors at a predetermined distance from respective insulation-piercing contacts.

A manually operated conductor insertion machine comprises a base for supporting an electrical connector and a table whose individual conductors are to be terminated in the connector, and a wheeled carriage mounted on the base for movement therealong in opposite directions. The base and carriage are generally constructed along the lines of the well-known credit card impression machines, and it will be readily understood from the following description that such machines may be adapted to great advantage to practice the present invention.

The carriage carries a rotatable member in the form of a gear whose teeth are a plurality of conductor insertion tools which sequentially press and force the conductors into the insulation-piercing contacts within respective channels of the connector as the carriage is moved along the base.

In two of the embodiments of the invention specifically described herein, the gear is a circular gear mounted for rotation about a vertical axis as the carriage moves along the base. In one of these two embodiments, the gear performs the insertion function as the carriage moves in one direction, while in the other embodiment, insertion is performed as the carriage moves in the opposite direction. In the first of these embodiments, a cutter carried by the carriage moves ahead of the insertion gear, while in the other embodiment, the individual gear teeth include a cutting edge for cutting the conductors as they are being inserted.

In a third embodiment of the invention disclosed herein, a sled-like member is advanced by the carriage to snug the conductors into the respective connector channels preparatory for insertion. The sled-like member carries a cutter for subsequently cutting the conductors to a desired length prior to insertion by a following insertion gear. The insertion gear in this embodiment is in the form of a pivotally mounted sector gear.

An electrical connector is advantageously provided when at least one ridge along the rear end thereof with a plurality of notches which communicate with respective ones of the connector channels which have the insulation-piercing contacts mounted therein. The individual conductors may be easily positioned with the aid of these notches for subsequent insertion and trimming operations.

BRIEF DESCRIPTION OF THE DRAWINGS

Other objects, features, and advantages of the invention, its organization, construction, and operation will be best understood from the following detailed description of preferred embodiments of the invention, taken in conjunction with the accompanying drawings, on which.

DESCRIPTION OF THE PREFERRED EMBODIMENTS

Figures 1, 2:
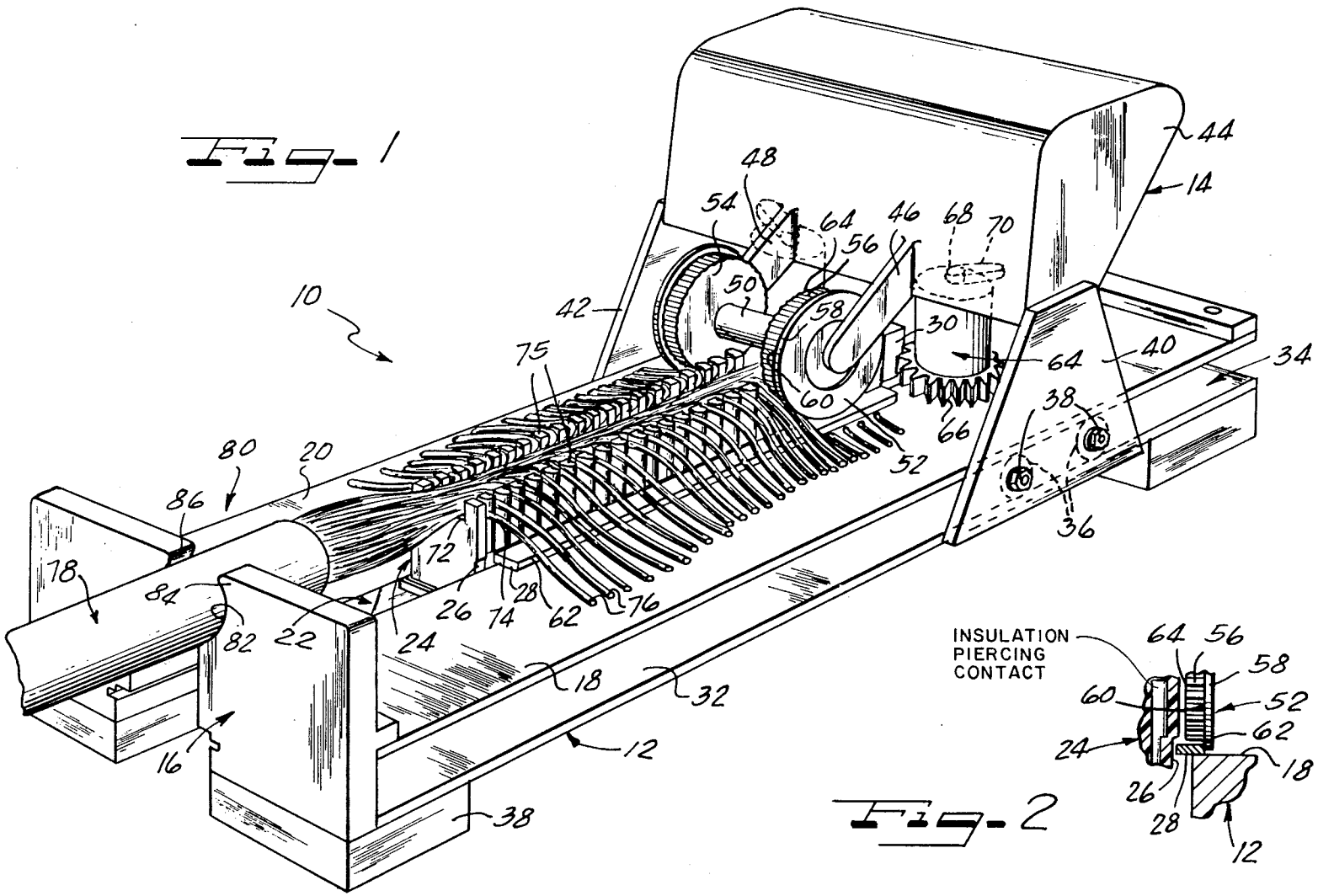
FIG. 1 is a pictorial representation of a first embodiment of a manually operated conductor terminating machine, shown during a cutting operation and just prior to conductor insertion.
FIG. 2 is a sectional, somewhat diagrammatic illustration of the relationship of the cutting apparatus illustrated in FIG. 1.

Referring to FIGS. 1 and 2, a conductor terminating machine is generally referenced 10 and illustrated as comprising a base 12, and a carriage 14 rollingly supported by the base 12.

At one end, the base 12 is provided with a spacing and fastening structure 16 for securing a pair of coplanar spaced plates, or spaced legs of the same plate, 18 and 20 in a vertically-spaced relationship with respect to a similar plate structure (only one being shown) in the form of the plate 32 to form a longitudinal channel 34 on each side of the base 12. Inasmuch as each of the embodiments of the apparatus of the invention are symmetrical, therefore the same on each side of the apparatus, only one side will be discussed in detail herein.

The spaced plates 18 and 20 define a channel 22 for receiving an electrical connector 24. The electrical connector 24 is provided with a groove 26 on each side thereof which receives a cutting bar 28 which is fixed to the base 12. Upon insertion into the slot 22, the electrical connector is moved against a lock stop 30 and is locked into position. Another stop may be affixed to the base 12 at the other end of the connector 24, if necessary.

The carriage 14 comprises a pair of downwardly extending side plates 40 and 42 which carry a plurality of rollers 36 within the channel 34. The rollers 36 are suitably journalled to the side plates at 38.

The carriage 14 also comprises a handle 44 secured between the side plates 40 and 42 for moving the carriage back and forth along the base and carrying the cutting and insertion mechanisms. A pair of forwardly and downwardly extending arms 46 and 48 rotatably carry a shaft 50 and a pair of cutting wheels 52 and 54 therebetween. Each cutting wheel includes a grooved surface 56 for receiving the individual conductors therein and a flange 58 having a cutting edge 60 which cooperates with a cutting edge 62 of the cutting bar 28 to cut the individual conductors at a predetermined distance from their respective insulation-piercing contacts, as the carriage is advanced to the left in FIG. 1.

Figure 9:
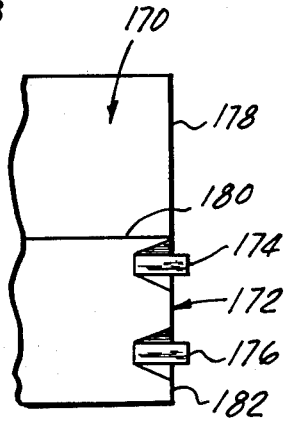
FIG. 9 is a side view of an insertion tool which advantageously may be utilized as the gear teeth for the apparatus illustrated in FIGS. 1, 3, and 5, shown on a greatly enlarged scale.

The carriage 14 also rotatably supports a cylindrical gear 64 having a plurality of teeth 66 which may advantageously be in the form of the insertion blade illustrated in FIG. 9.

The gear 64 is rotatably mounted at 68 and adapted for movement toward and away from the connector by a mechanism illustrated at 70. This mechanism may take the form of an angularly disposed slot or a lever and stop arrangement wherein the gear 64 does not function to insert the conductors in their respective channels on movement of the carriage toward the left, but is moved toward the connector for the insertion operation as the carriage is moved in the opposite direction. This feature permits an operator to clear wire trimmings out of the way before insertion, if necessary.

The connector 24 is provided with a longitudinally extending slot 72, which receives all of the conductors therein for guided direction into individual contact containing channels 74 by communication through respective notches 75 between the longitudinal groove 72 and the individual channels 74. This feature aids in guiding and aligning the conductors 76 for proper cutting and insertion, and may also be advantageously utilized with the other embodiments of the invention.

In operation, the connector 24 is slid into the slot 22 to lock stop 30 and the table of 78 of pressed into a cavity 82 of a holder 80 through a narrower passage formed between a pair of projections 84 and 86. The conductors are then dressed into the comb slots or notches 75 in accordance with a desired contact termination schedule. The carriage 14 is then moved toward the left to push down and snug the wires within the notches 75 and to cut the individual conductors to predetermined lengths. During this movement, the gear 64 is laterally displaced away from the connector. Finally, the carriage 14 is returned in the opposite direction, during which time the gear 64 is moved toward the connectors so that the insertion teeth 66 promptly insert the conductors 76 into the respective insulation-piercing contacts mounted within the channels 74. The terminated cable and connector is then removed from the fixture.

Figures 3, 4:
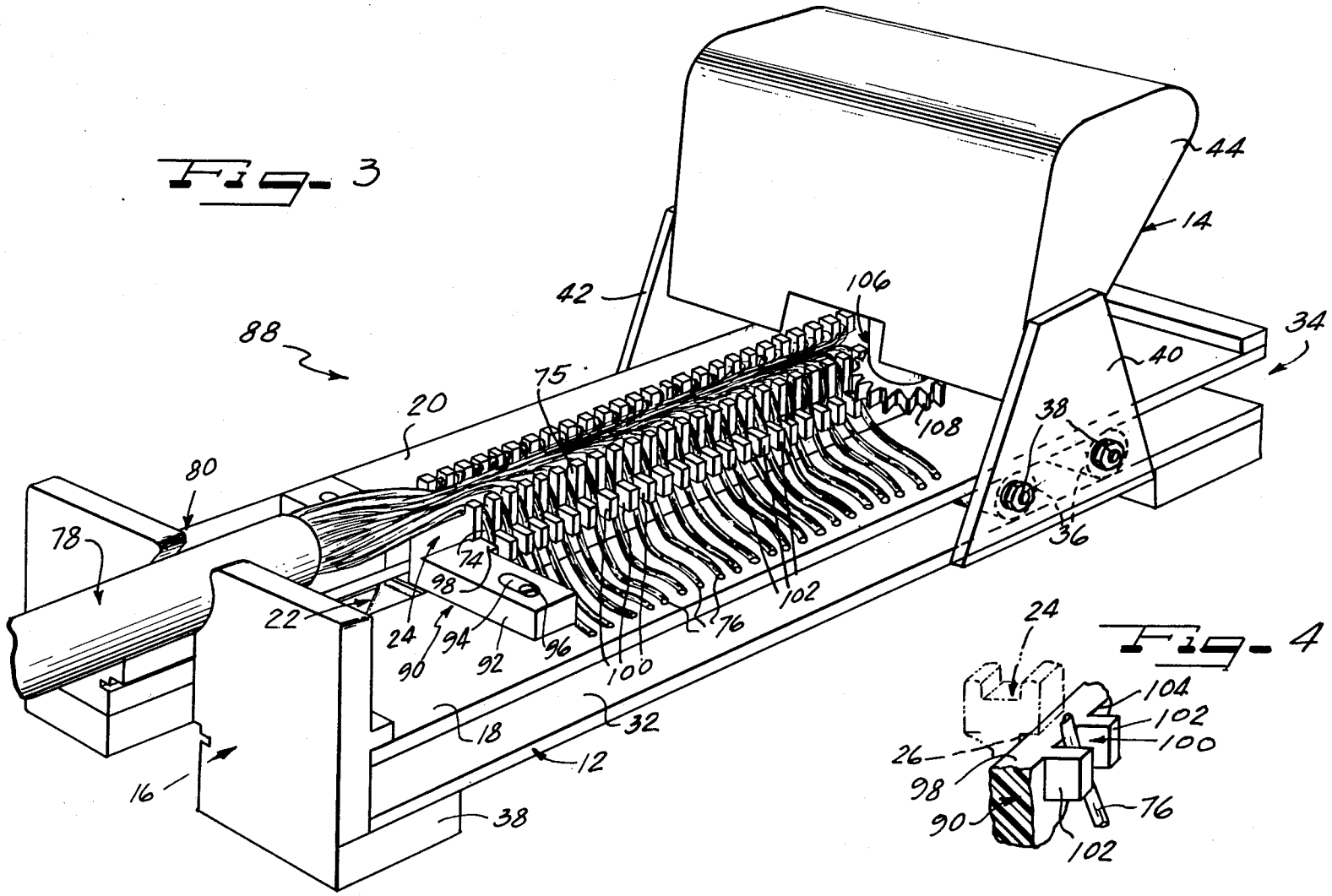
FIG. 3 is a pictorial representation of a second embodiment of the invention, showing the utilization of a conductor aligning comb and cutting bar which is cooperable with an insertion gear having cutting edges on the piece thereof.
FIG. 4 is a pictorial representation of a portion of the cutting bar illustrated in FIG. 3, shown on a larger scale.

Referring now to FIGS. 3 and 4, it is readily apparent that the base 12 and the carriage 14 are basically the same as illustrated in FIGS. 1 and 2, and a detailed description of that apparatus will not be given here. In FIG. 3, however, a manually operated terminating machine is generally indicated at 88 as comprising, on each side of the machine, a comb 90 having a portion 92 with an elongate adjustment aperture 94 therein which receives a screw 96 for permitting movement of the comb 90 toward and away from the connector 24. The comb 90 includes another portion 98 which extends into the groove 26 in a manner similar to the cutting member 28 of FIGS. 1 and 2. The portion 98 includes a plurality of notches 100 between the fingers 102 of the comb, and a back edge 104 of each notch which forms a cutting edge for the respective conductor 76.

In this embodiment of the invention, the cutting and insertion operations are performed in a sequential, staggered sequence during a single traverse of the carriage 14 along the connector. More specifically, the carriage 14 carries a cylindrical gear 106 having gear teeth 108 with a sharp lower edge (edge 182 in FIG. 9) which cooperates with the edge 104 within each notch 100 to cut the conductor immediately prior to insertion into the respective channel. As the gear 106 traverses the connector 24, each conductor is first cut and then inserted before the next conductor is cut and inserted.

In operation, the connector 24 is slid into the slot 22 in much the same manner as in FIG. 1 to rest against a lock stop (not shown). The comb 90 may be moved laterally to permit ease of entry of the connector 24, or to permit different widths of connectors to be terminated on the same machine. The cable 78 is pressed into the holder 80 and the individual conductors are pressed into the notches 75 and the notches 100. The carriage 14 is then moved to carry the gear 106 along the connector 24 to sequentially cut and insert the conductors into the slots 74. The carriage 14 is then returned to the left and the terminated cable and conductor are removed from the fixture.

Referring now to FIGS. 5-8, a third embodiment of the invention, the most preferred embodiment, is illustrated as comprising a pair of cooperable sections 112 by which the base may be shaped, or which may be carried on the base of the previously described apparatus. The cooperable members 111 and 113 of the apparatus 112 define a slot 122 for receiving the connector 24 as previously described.

The member 113 (and likewise the member 111) comprises a horizontal surface 114 and an intregal cutting bar portion 116 having a cutting edge 118 disposed parallel to the connector 24 and partially received within the groove 26 thereof.

The member 113 (and the member 111) includes a downwardly and outwardly sloping surface 120 for draping of the conductors 76.

Inasmuch as the apparatus 112 may replace or be mounted upon the upper surface 18 of the base 12 illustrated in FIGS. 1 and 3, a channel for receiving the rollers of the carriage is diagrammatically illustrated at reference 34 as in the previous figures.

In this particular embodiment, the carriage 130 is also provided with a plurality of rollers or wheels 36 journalled at 38 to a pair of downwardly and forwardly extending side walls 132 and 134.

The side walls 132 and 134 are spaced apart and interconnected by a member 136 which carries a handle 138 connected between a pair of spaced extending arms 140 and 142.

The member 136 includes a forwardly facing surface 144 which carries a pair of sled-like members or boots 146 and 148, each of which includes a forwardly and upwardly extending rounded edged surface 150 and a cutting blade 152 mounted within a recess 166.

Each boot 146, 148 includes a downwardly projecting wedgelike portion 154 for moving the trimmed conductors outwardly of the connector 24 after the same have been cut from the ends of the conductors 76.

Each boot 146, 148 is designed to move along the cutting edge 118 to snug the conductors into their respective notches (75 in FIGS. 1 and 3) in such a manner that the cutting blade 152 cooperates with the cutting edge 118 to cut the conductors. The trimmed ends of the conductors 76 are ploughed outwardly by the wedge-like portions 154 to displace the same in a noninterfering relationship with the subsequently received conductor end insertion apparatus.

In this embodiment, a sector gear 156 is pivotally mounted to the member 136 for rotation about an axis, here the pin 158. The sector gear includes a plurality of teeth 160, constructed as illustrated in FIG. 9, for inserting the trimmed conductors 76 into the respective channels and insulation-piercing contacts of the connector 24.

Figure 5:
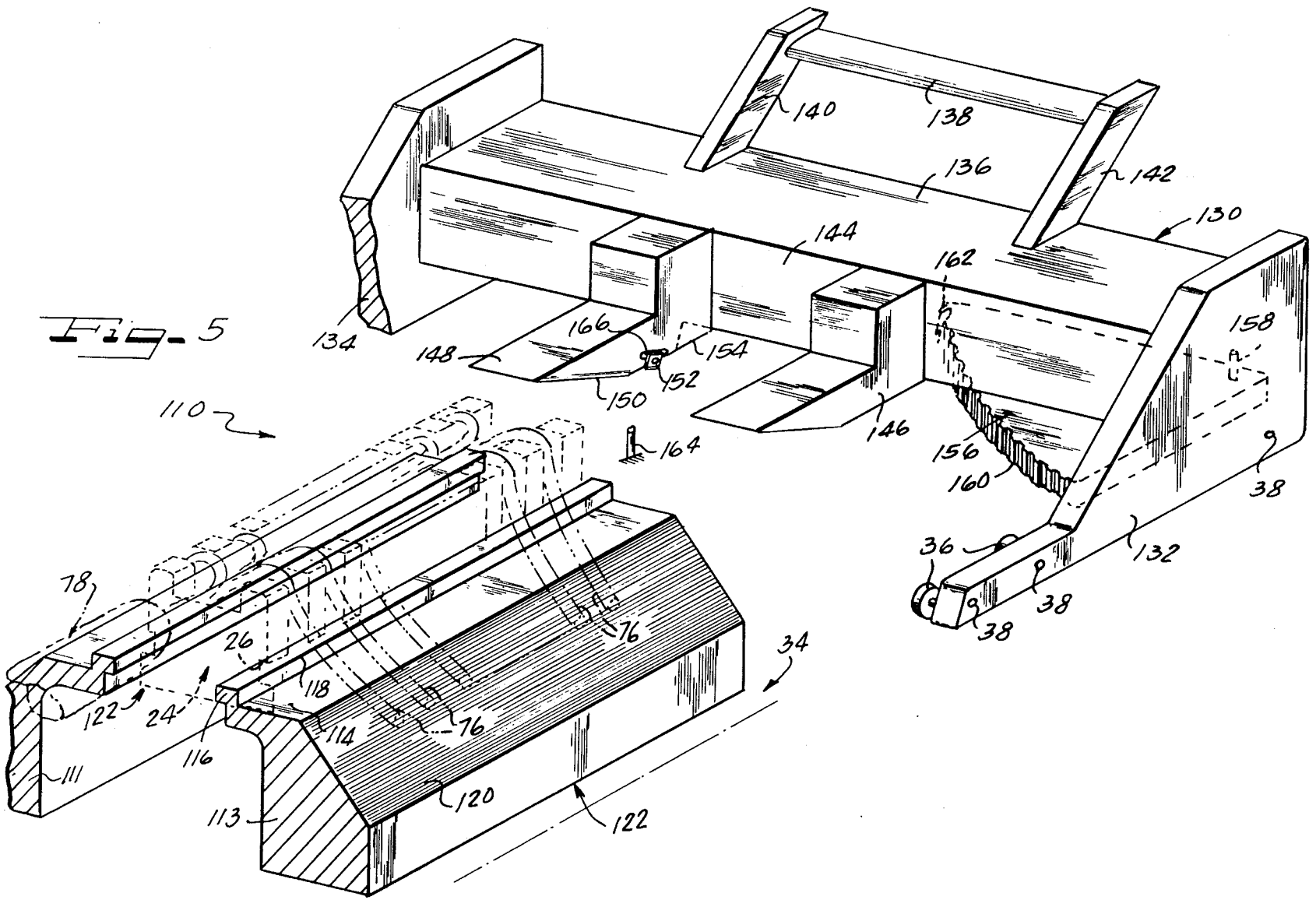
FIG. 5 is an exploded pictorial representation of a third terminating machine constructed according to the invention, specifically showing conductor snugging sled-like members which carry wire cutting blades in advance of a sector gear insertion tool.

As the carriage 130 is moved to the left in FIG. 5, the individual conductors are sequentially snugged, then cut, and then inserted by the teeth 160 of the sector gear 156. In order to initiate the insertion operation, the sector gear 156 is provided with a hook or other means 162 for engaging a pin 164, or the like, to initiate pivotal action about the pin 158.

Figure 6:
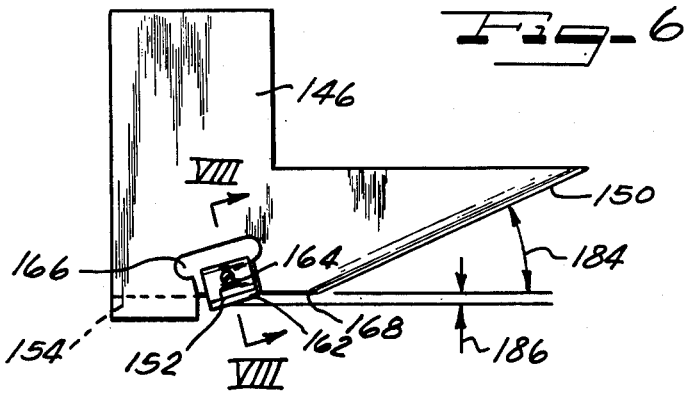
FIG. 6 is an elevation of a sled-like member utilized in the apparatus of FIG. 5.
Figure 7:
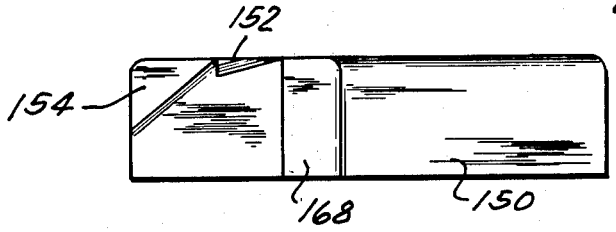
FIG. 7 is a bottom view of the sled-like member illustrated in FIG. 6.
Figure 8:
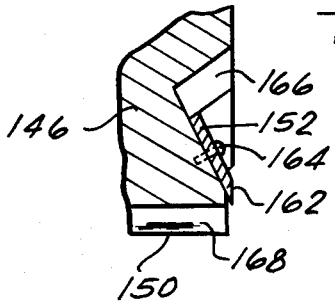
FIG. 8 is a partial sectional view taken along the line VIII—VIII of FIG. 6.

Referring to FIGS. 6–8, one of the boots 146 is illustrated, particularly from an inside view thereof, wherein a cutting blade 152 is secured within a recess 166 by a screw 164. The cutting blade 152 includes a sharpened cutting edge 162 which is disposed at an angle to create a cutting depth below horizontal, that is, below the cutting edge 118 of, for example, 0.30–0.40 inches. This dimension is illustrated by the arrows referenced 186. The angle of attack of the rounded edge surface 150 has been found to be 15°, the plough 30°, in a particular application, with the rounded edge being at $\frac{1}{8}$ inch radius. The particular blade angle found advantageous in cooperation with the other angular structure was 8°, with respect to horizontal.

As can be seen from FIG. 6, and particularly from FIG. 7, a waste conductor plough 154 is provided to extend downwardly from an angle to urge the trimmed conductors out of the way of the advancing sector gear 156.

It will be noted from the drawings that the surface 168 is adapted to slide over the conductors and snug the same as they are advanced between the surface 150 and the cutting bar 116, severing of the conductors occurring after snugging of the same.

Referring to FIG. 9, an elevational view of an insertion tool 170 is illustrated as comprising a conductor engaging and pressing edge 172 having a pair of spaced projections 174, 176 spaced to span a set of insulation-piercing contacts and insure bottoming of the conductor within the contacts. The insertion blade 170 may also include a narrow edge 178 formed by milling one or more faces of the blade, as indicated at 180, to press the conductor into a strain release mechanism formed at the outermost ends of the connector, in the area of the notched ridge having the notches 75 therein, or simply to insure pressing of the conductor within the channels and notches 74 and 75. Although this particular insertion tool blade construction is illustrated herein, any other suitable tool structure may be employed for the gear teeth of the gears 64, 106, and 156 of FIGS. 1, 3, and 5.

Although I have described my invention by reference to specific illustrative embodiments thereof, these illustrations have been provided as non-limiting examples of the invention, and many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

The embodiments of the invention in which an exclusive property or privilege is claimed are as follows:

1. An electrical connector comprising:

a contact support including a rear end element;

means defining a plurality of channels in said end element, each of said channels opening laterally outwardly of said end element;

a plurality of insulation-piercing contact portions disposed in said channels and supported by said contact support;

a ridge extending rearwardly from said end element and transversely across said channels; and notch means defining a plurality of rearwardly open notches in said ridge, each of said notches contiguously opening into and communicating with a respective channel to receive and hold a respective conductor.

2. An electrical connector comprising:

a contact support including a rear end element;

means defining a plurality of parallel channels in each side of said end element, said channels opening laterally outwardly of said end element;

a plurality of insulation-piercing contact portions disposed in said channels and supported by said contact portion;

a pair of parallel ridges defining a slot therebetween and extending rearwardly from said rear end element adjacent respective sides thereof and transversely across said channels of the respective sides; and notch means defining a plurality of rearwardly open notches in said ridges contiguously opening into the slot and contiguously opening into said channels and communicating the slot and said channels for receiving and holding respective conductors.

3. An electrical connector comprising:

a contact support including a rear end element;

means defining a plurality of L-shaped passageways disposed in a side-by-side relation in each side of said end element, each of said passageways opening laterally outwardly of said end element and rearwardly of said end element;

an elongate rearwardly opening slot in said rear end element directly communicating with each of said L-shaped passageways; and a plurality of insulation-piercing contact portions disposed in respective ones of said passageways and supported by said contact support in the laterally outwardly opening portions of said passageways, whereby a plurality of conductors are provided with a common path through said slot and respective paths through said L-shaped passageways for termination in respective ones of said insulation-piercing contact portions.

* * * * *